US007975730B2

(12) United States Patent
Bolton

(10) Patent No.: US 7,975,730 B2
(45) Date of Patent: Jul. 12, 2011

(54) COLOURING APPARATUS

(75) Inventor: Terence William Bolton, Redhill (GB)

(73) Assignee: LaJa Materials Limited

( * ) Notice: Subject to any disclaimer, the term of this patent is extended or adjusted under 35 U.S.C. 154(b) by 1113 days.

(21) Appl. No.: 10/592,083

(22) PCT Filed: Dec. 29, 2005

(86) PCT No.: PCT/GB2005/005094
§ 371 (c)(1),
(2), (4) Date: Feb. 12, 2007

(87) PCT Pub. No.: WO2006/070193
PCT Pub. Date: Jul. 6, 2006

(65) Prior Publication Data

US 2007/0189838 A1 Aug. 16, 2007

(30) Foreign Application Priority Data

Dec. 30, 2004 (GB) ..... 0428442.8

(51) Int. Cl.
*B65B 29/00* (2006.01)

(52) U.S. Cl. ..... 141/20.5; 141/270; 401/195; 401/196; 401/202

(58) Field of Classification Search ..... 141/18, 141/20.5, 250, 266, 270, 319, 346, 368; 401/195, 401/196, 198, 199, 202
See application file for complete search history.

(56) References Cited

U.S. PATENT DOCUMENTS

| | | | | |
|---|---|---|---|---|
| 3,020,578 | A * | 2/1962 | Rosenthal | 401/118 |
| 3,195,169 | A * | 7/1965 | Chadboarn | 401/119 |
| 3,480,371 | A * | 11/1969 | Lee | 401/121 |
| 3,887,287 | A | 6/1975 | Rosh, Jr. | |
| 4,614,163 | A * | 9/1986 | Hetzer et al. | 118/268 |
| 5,203,638 | A | 4/1993 | Redmond, Jr. | |
| 5,626,431 | A * | 5/1997 | Hetzer et al. | 401/119 |
| 5,641,078 | A * | 6/1997 | Kaufmann | 211/69.4 |
| 5,651,627 | A | 7/1997 | Dowzall et al. | |
| 5,813,787 | A | 9/1998 | Dowzall et al. | |
| 7,004,660 | B2 * | 2/2006 | Kaempf | 401/202 |
| 7,470,079 | B2 * | 12/2008 | Bedhome et al. | 401/199 |

FOREIGN PATENT DOCUMENTS

| | | |
|---|---|---|
| EP | 0 630 326 | 7/1996 |
| GB | 2 277 253 | 10/1994 |
| WO | WO 94/00997 | 1/1994 |
| WO | WO 01/15912 | 8/2001 |

OTHER PUBLICATIONS

International Preliminary Examination Report, Jul. 12, 2007.

* cited by examiner

*Primary Examiner* — Gregory L Huson
*Assistant Examiner* — Jason K Niesz
(74) *Attorney, Agent, or Firm* — Michael D. Eisenberg

(57) ABSTRACT

Coloring apparatus comprises a first marker pen having a housing including an absorbent nib containing a liquid or dye of a first color, and a second marker pen having a housing including an absorbent nib containing a liquid or dye of a second color. The housings of the marker pens are dimensioned and shaped to engage opposing end portions of a tubular docking member with their absorbent nibs spaced one from the other. Means are provided to enable relative movement to take place between the pens while in position within the docking member thereby causing the absorbent nibs selectively to make contact with one another within the docking member and to be released from such contact.

12 Claims, 2 Drawing Sheets

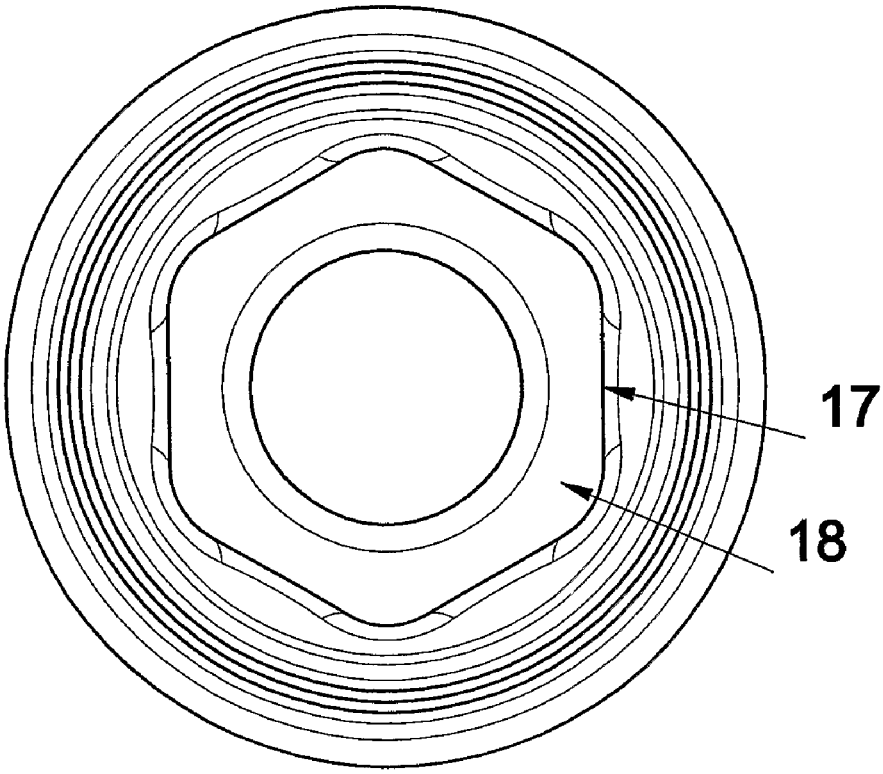
FIG. 5
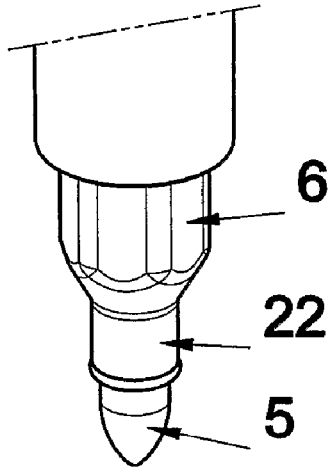
FIG. 6
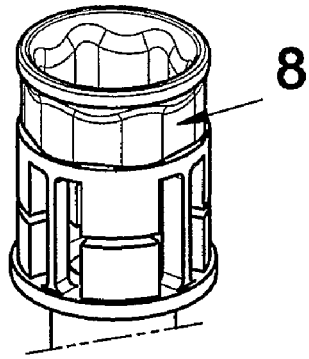

COLOURING APPARATUS

This invention relates to colouring apparatus. More especially, the invention relates to colouring apparatus for use with marker pens.

Typically marker pens comprise a tubular housing having a fibrous felt-like nib connected via a liquid absorbent wick to an internal chamber containing a fluid indicator such as a water-based ink which contains a coloured dye (hereinafter referred to as a "dye" or "coloured dye" for ease of understanding). As the marker pen is used, the fibrous nib is replenished with indicator fluid which travels through the wick from the chamber by capillary action to the nib. Such pens are well known and are used inter alia to mark text and produce coloured effects on paper or similar materials.

Generally, a marker pen is dedicated to producing a single colour. If two or more colours are required, the same number of individual pens are normally required. Marker pens having more than one nib have been proposed, the intention of these being to produce two or more side-by-side coloured lines with one stroke of a pen or a single line of a selected colour. Such a marker pen is disclosed in WO 94/0997, WO 01/15912, U.S. Pat. No. 5,203,638, U.S. Pat. No. 3,887,287, UK-A-2277253. Marker pens are also known in which a finer nib can overlie a larger nib to enable a single pen to produce lines of different widths. Such pens are disclosed in EP-A-630326, U.S. Pat. No. 5,813,787 and U.S. Pat. No. 5,651,627. The Applicant's earlier application, PCT/GB2004/000859 discloses a marker pen having a casing including a fluid absorbent nib containing a liquid or dye of a first colour, the interior of the casing being adapted to receive at least a portion of a marker pen having a fluid absorbent nib containing a liquid or dye of a second colour which, when the marker pen is inserted into the open end of the casing, makes contact with the marker nib to allow donation of the second colour to produce a colour change in a single line or succession of such lines using the same marker pen.

One object of the present invention is to provide alternative apparatus capable of enabling a marker pen consistently to produce in a line or succession of lines a uniform and consistent colour change from one colour to another colour.

In a first aspect, there is provided apparatus for conveying a liquid or dye from one marker pen to another, the apparatus comprising a tubular docking member having one end shaped and dimensioned to engage with an end portion including the nib of a first marker pen and the other end shaped and dimensioned to engage with an end portion including the nib of a second marker pen, the docking member being of such length that, when the end portions of the first and second member pens are engaged within the respective ends of the docking member the marker pen nibs are spaced one from the other, and means for enabling relative movement between the pens while in position within the docking member firstly to reduce the distance between the pens and cause the pen nibs to come into contact thereby enabling liquid or dye to pass therebetween, and secondly to return the pens to their starting positions and to cause the pen nibs to be released from contact one with the other.

The liquid may comprise a translucent liquid such as water and the dye may comprise an indicator such as a water-based ink containing coloured dyes, dispersed pigments or other colouring media. Alternatively, the coloured dye may be oil-based.

The marker pen nibs may be produced from a fibrous material such as felt. Alternatively, one or each nib may be produced from a relatively inflexible material; a preferred material is that marketed under the trade mark POREX. This is a porous fluid retaining substance which holds its shape when applied to a surface in the manner of a marker to paper, card or like material. Other materials having similar physical properties may, however, be used.

In a second aspect, the invention provides colouring apparatus comprising a first marker pen having a housing including an absorbent nib containing a liquid or dye of a first colour, and a second marker pen having a housing including an absorbent nib containing a liquid or dye of a second colour, the housings of the first and second marker pens being dimensioned and shaped to engage opposing end portions of a tubular docking member with their absorbent nibs spaced one from the other, and means for enabling relative movement between the pens while in position within the docking member thereby causing the absorbent nibs selectively to make contact with one another within the docking member and to be released from such contact.

The docking member preferably has at each open end a cap dimensioned to receive the absorbent nib and adjoining end piece of a marker pen with the internal walls of the cap in contact with the external surfaces of the end piece of the received marker pen, and a tubular housing positioned between the two caps into which the absorbent nibs project when marker pens are held within the caps, the overall length of the docking member being such that the absorbent nibs are initially spaced from one another within the confines of the housing but are selectively placed in contact with one another through operation of the enabling means.

In one embodiment, each cap comprises two cap sections separated by a peripheral slot which lies in a plane normal or inclined to the longitudinal axis of the cap, the cap sections being joined by at least one leg located in and spaced from the margins of an; opening formed in a side wall of the cap, the opening lying in a plane which lies generally parallel or inclined to the longitudinal axis of the cap, the arrangement being such that movement of one cap section relative to the adjoining cap section has the effect of reducing the cap height thereby enabling a marker pen held within that cap to project into the housing by a distance substantially equal to the depth of the peripheral slot.

In a third aspect, the invention provides a generally cylindrical elongate open-ended docking member for receiving marker pens of colouring apparatus, the docking member including at each of its open ends a cap dimensioned to receive the absorbent nib and adjoining end piece of a marker pen, and a tubular housing positioned between the two caps into which, in use, the absorbent nibs project when marker pens are held within the caps, each cap comprising two cap sections separated by a slot which lies in a plane normal or inclined to the longitudinal axis of the cap and which extends around a major part of the periphery of the cap whereby the cap sections are joined one to the other by one or more discrete cap pieces spaced within the confines of the slot, the arrangement being such that movement of one cap section relative to its adjoining cap section has the effect of reducing the cap height thereby enabling a marker pen held within that cap to project into the housing by a distance substantially equal to the depth of the peripheral slot.

The internal walls of the cap are preferably shaped to complement that of the end piece of a received marker pen to prevent or at least inhibit relative rotation between the end piece and the cap during operation of the enabling means. Thus, the internal walls of the cap may include flats which complement flats formed on the external walls of the marker end piece. Alternatively, the internal walls of the cap may include longitudinal grooves or ribs which complement ribs or grooves respectively formed in or on the outer walls of the marker end piece.

In a fourth aspect, the invention provides a marker pen having an elongate generally tubular housing having a collar from which protrudes an absorbent nib, the marker pen collar including one or more longitudinally extending surfaces which complement similar surfaces found on the interior of the cap sections of the docking member disclosed in the preceding eight paragraphs.

The invention will now be described by way of example only with reference to the accompanying diagrammatic drawings, in which:

FIG. 5 is an end view to an enlarged scale of the illustrated docking member; and FIG. 6 is a perspective view showing the illustrated docking member and a marker pen about to be assembled.

Figure 1:
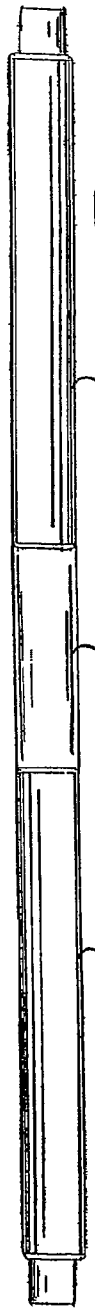
FIG. 1 is a side view of assembled colouring apparatus in accordance with the invention.
Figure 2:
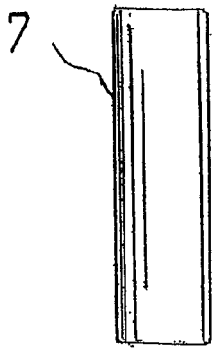
FIG. 2 is a side view of a marker pen which forms part of the apparatus illustrated in FIG. 1.

FIG. 1 illustrates colouring apparatus in accordance with the invention which comprises two marker pens 1 whose ends project in the open ends of a tubular docking member 2. One such marker pen is illustrated in FIG. 2. Each marker pen 1 comprises an elongate generally tubular housing 3 having a collar 4 from which protrudes a fibrous felt-like absorbent nib 5 connected via a liquid absorbent wick (not shown) to an internal chamber (not shown) containing a fluid indicator such as a water-based ink which contains a coloured dye (hereinafter referred to as a dye or coloured dye for ease of understanding). As shown in FIG. 2, the collar 4 is formed with flat surfaces 6 extending lengthwise of the collar.

The marker pen nibs 5 may be produced from a fibrous material such as felt. Alternatively, one or each nib may be produced from a relatively inflexible material; a preferred material is that marketed under the trade mark POREX. This is a porous fluid retaining substance which holds its shape when applied to a surface in the manner of a marker to paper, card or like material. Other materials having similar physical properties may, however, be used.

A removable cap 7 is provided to seal the absorbent nib 5 when the pen is not in use.

Figure 3:
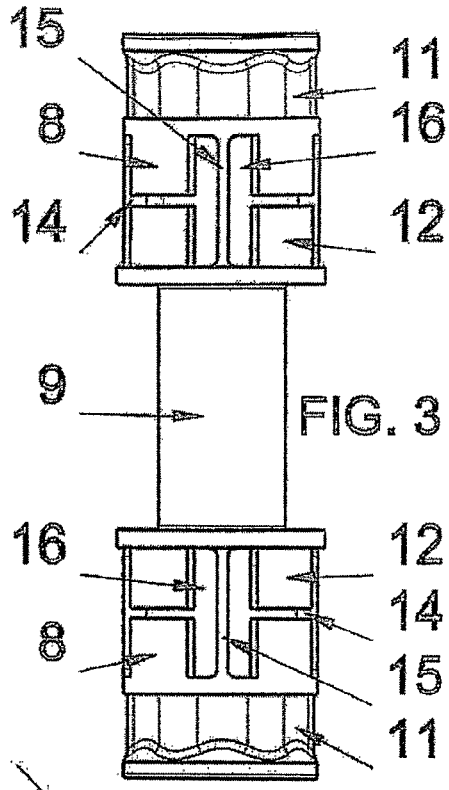
FIG. 3 is a side view of a docking member which forms part of the colouring apparatus shown in FIG. 1.
Figure 4:
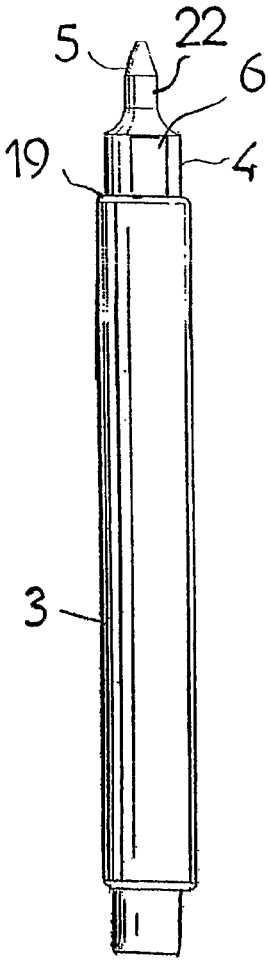
FIG. 4 is a longitudinal section taken through the docking member illustrated in FIG. 2.
Figure 4:
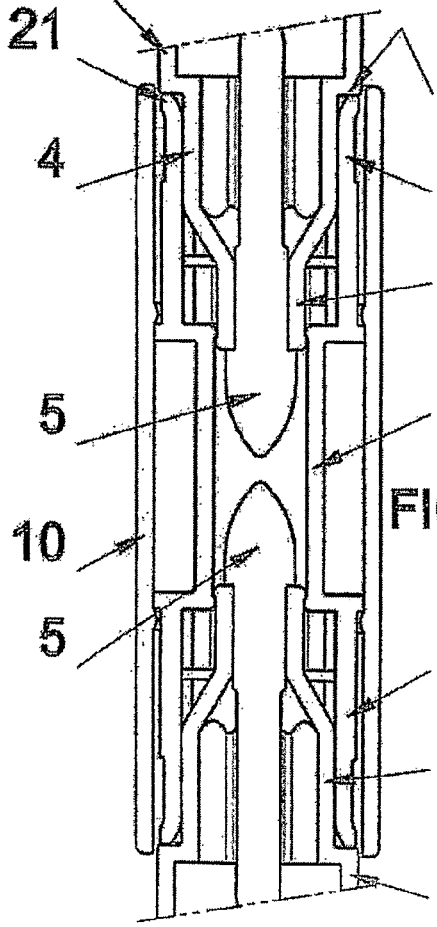

As will be seen from FIGS. 3 and 4, the docking member 2 comprises an open ended tubular member having end caps 8 separated by a tubular housing 9. The internal shape and dimensions of each end cap 8 complements the shape and dimensions of the collar 4 of the marker pen 1. Thus, the internal dimensions of the each cap 8 of the docking member 2 are slightly greater than the outer dimensions of the collar 4, to enable each collar 4, in use, to fit relatively snugly within the respective end cap 8.

As will be seen from FIG. 3, each cap 8 comprises outer and inner sections 11, 12 respectively separated by a peripheral slot 14 and joined together by four longitudinally projecting legs 15 (only one of which for each cap is shown) positioned generally equidistant around the circumference of the cap. As shown, each slot 14 lies in a plane generally normal to the longitudinal axis of the cap. This plane may, however, be inclined with respect to the cap longitudinal axis. The legs as illustrated extend generally parallel to the cap longitudinal axis, but could be inclined thereto. Also, the shape of each leg may be different from that illustrated. Each leg 15 is located within a lengthwise extending opening 16. The dimensions of the slots 14, the openings 16 and the legs 15 are selected to enable the opposed edges of each slot 14 to move towards one another and abut upon rotation of one cap section relative to the other cap section. Rotation of one cap section relative to the other is enabled by the presence of the slot 14, the opening 16 and the relatively thin legs 15. This rotation effectively reduces the height of the cap.

As will be seen more clearly from FIG. 4, the assembly of the caps 8 and tubular housing 9 are located within a tubular casing 10. Each cap 8 has an inner tubular side wall formed with a plurality of flat longitudinally extending internal surfaces 17 (see FIG. 5) and an annular floor 15. Marker pens 1 are shown in FIG. 4 with their collars 4 and absorbent nibs 5 positioned within the caps 8 of the docking member 2. When so positioned, the flat surfaces 6 of each collar abut and engage with the internal flat surfaces 17 of the respective cap 8. This inter-engagement prevents relative rotation between the marker pens 1 and the docking member 2. The outer rim 21 of each cap acts as an abutting surface which engages the end face 19 of each marker 1 to control the extent to which the pens can penetrate the docking member. As will be seen from FIG. 4, in their docked positions, the pen nibs 5 extend into the tubular housing 9 but are spaced apart by a relatively small distance. The nib retaining sleeve 22 of each pen projects with the pen nib into the respective open end of the tubular housing.

To move the nibs into contact with one another, one or both markers 1 are rotated or twisted by hand to a limited extent thereby effecting rotation of the or each cap section 11 relative to the or each cap section 12 thereby to reduce the effective height of one or each cap and to enable the nibs to make contact one with the other. After a few seconds, the marker or markers are released to cause the cap sections to return to their original positions and to move the marker nibs out of contact.

The described limited movement between the nibs can be achieved by embodiments other than that described. Thus, a slot 14, legs 15 and openings 16 may be positioned within the wall of the tubular housing 9 instead of the caps 8. Also, one or each cap may be connected to the tubular housing 9 in such a way that limited relative movement of one or each cap relative to the housing in a direction generally parallel to the longitudinal axis of the housing 9 is possible. Thus, the caps may not be integral with the housing 9 but capable of sliding movement towards and away from the housing. In this arrangement, the required relative movement may be achieved by applying finger pressure to the end of one or both marker pens held within the caps. A spring may be provided between the abutting ends of each cap 8 and the housing 9 to cause the caps to return to their starting positions once the finger pressure is removed.

In use of the illustrated apparatus, marker pens 1 containing different colorants are inserted into the open ends of the caps 8 as shown in FIG. 6. As described above, in this position the nibs of each marker pen 1 project into the tubular housing 9 but are spaced one from the other. One or both caps are then rotated to cause the nibs to make contact one with the other for a few seconds and then released to move the nibs apart. Typically the contact time is around 5 seconds.

This contact between the nibs allows a transfer of coloured dye from one nib to the other nib. To assist this transfer, it is preferred that the docking member is held with one marker pen higher than the other. The docking member 2 acts to channel dye between the nibs and prevent leakage of the coloured dye to the outside of the apparatus. The need physically to rotate or twist one or both marker pens to achieve the required contact between the marker nibs ensures that a transfer of colourant only occurs over a relatively short but controlled period of time. Also, by carefully selection of the dimensions of the slots 4, the legs 15 and the openings 16, the contact pressure between the nibs can be minimised.

By use of the described apparatus, an effective and consistent colour change is effected. Once a marker pen having donated fluid is removed from the docking member, it can be used to produce a single or series of lines which initially show a first colour (the colour donated from the other marker pen) which gradually and consistently changes to show a second colour (the original colour of that pen). The line between these two extremes gradually changes in colour as the length of the line or lines progresses. A number of colour changes can, of course, be effected simply by appropriate selection of the original and donated colours. Thus, donated liquid may be, for example, water. In this arrangement, the line produced will essentially comprise a line which is initially transparent but gradually becomes coloured as the line progresses.

It will be appreciated that the foregoing is merely exemplary of marker pens in accordance with the invention and that various modifications can readily be made thereto without departing from the true scope of the invention described.

The invention claimed is:

1. Apparatus for conveying a liquid or dye from one marker pen to another, the apparatus comprising a tubular docking member having one end shaped and dimensioned to engage with an end portion including the nib of a first marker pen and the other end shaped and dimensioned to engage with an end portion including the nib of a second marker pen, the docking member being of such length that, when the end portions of the first and second member pens are engaged within the respective ends of the docking member the marker pen nibs are spaced one from the other, and means for enabling relative movement between the pens while in position within the docking member firstly to reduce the distance between the pens and cause the pen nibs to come into contact thereby enabling liquid or dye to pass therebetween, and secondly to return the pens to their starting positions and to cause the pen nibs to be released from contact one with the other.

2. Apparatus as claimed in claim 1 wherein the liquid comprises a translucent liquid.

3. Apparatus as claimed in claim 1 wherein the dye comprises an indicator, a water-based ink containing a coloured dye or a dispersed pigment.

4. Apparatus as claimed in claim 1 wherein the marker pen nibs are produced from a fibrous material.

5. Apparatus as claimed in claim 1 wherein one or each nib is produced from a relatively inflexible material.

6. Colouring apparatus comprising a tubular docking member, a first marker pen having a housing including an absorbent nib containing a liquid or dye of a first colour, and a second marker pen having a housing including an absorbent nib containing a liquid or dye of a second colour, the housings of the first and second marker pens being dimensioned and shaped to engage opposing end portions of the tubular docking member with their absorbent nibs spaced one from the other, and means for enabling relative movement between the pens while in position within the docking member thereby causing the absorbent nibs selectively to make contact with one another within the docking member and to be released from such contact.

7. Apparatus as claimed in claim 6 wherein the docking member has at each open end a cap dimensioned to receive the absorbent nib and adjoining end piece of a marker pen with the internal walls of the cap in contact with the external surfaces of the end piece of the received marker pen, and a tubular housing positioned between the two caps into which the absorbent nibs project when marker pens are held within the caps, the overall length of the docking member being such that the absorbent nibs are initially spaced from one another within the confines of the housing but are selectively placed in contact with one another through operation of the enabling means.

8. Apparatus as claimed in claim 7 wherein each cap comprises two cap sections separated by a peripheral slot which lies in a plane normal or inclined to the longitudinal axis of the cap, the cap sections being joined by at east one leg located in and spaced from the margins of an opening formed in a side wall of the cap, the opening lying in a plane which lies generally parallel or inclined to the longitudinal axis of the cap, the arrangement being such that movement of one cap section relative to the adjoining cap section has the effect of reducing the cap height thereby enabling a marker pen held within that cap to project onto the housing by a distance substantially equal to the depth of the peripheral slot.

9. A generally cylindrical elongate open-ended docking member for receiving marker pens of colouring apparatus, the docking member including at each of its open ends a cap dimensioned to receive the absorbent nib and adjoining end piece of a marker pen, and a tubular housing positioned between the two caps into which, in use, the absorbent nibs project when marker pens are held within the caps, each cap comprising two cap sections separated by a slot which lies in a plane normal or inclined to the longitudinal axis of the cap and which extends around a major part of the periphery of the cap whereby the cap sections are joined one to the other by one or more discrete cap pieces spaced within the confines of the slot, the arrangement being such that movement of one cap section relative to its adjoining cap section has the effect of reducing the cap height thereby enabling a marker pen held within that cap to project into the housing by a distance substantially equal to the depth of the peripheral slot.

10. A docking member as claimed in claim 9 wherein the internal walls of the cap are shaped to complement that of the end piece of a received marker pen to prevent or at least inhibit relative rotation between the end piece and the cap during operation of the enabling means.

11. A docking member as claimed in claim 10 wherein the internal walls of the cap include flats which complement flats formed on the external walls of the marker end piece.

12. A docking member as claimed in claim 10 wherein the internal walls of the cap include longitudinal grooves or ribs which complement ribs or grooves respectively formed in or on the outer wails of the marker end piece.

* * * * *